US005429765A

United States Patent [19]

Flower

[11] Patent Number: 5,429,765

[45] Date of Patent: Jul. 4, 1995

[54] DETERGENT AND METHOD FOR PRODUCING THE SAME

[75] Inventor: David M. Flower, Grand Rapids, Mich.

[73] Assignee: Amway Corporation, Ada, Mich.

[21] Appl. No.: 54,962

[22] Filed: Apr. 29, 1993

[51] Int. Cl.[6] ..... C11D 3/386

[52] U.S. Cl. ..... 252/174.12; 252/174.14; 252/DIG. 12; 435/219; 435/230; 435/221; 435/222; 435/223; 435/224; 435/225; 8/137

[58] Field of Search ..... 252/174.12, 174.14, 252/DIG. 12; 435/219-225; 8/137

[56] References Cited

U.S. PATENT DOCUMENTS

| | | | |
|---|---|---|---|
| 1,660,458 | 2/1928 | Takamine et al. . | |
| 2,607,359 | 8/1952 | Oesting | 134/30 |
| 3,629,123 | 12/1971 | O'Reilly et al. | 252/89 |
| 3,634,266 | 1/1972 | Theile et al. | 252/132 |
| 3,635,797 | 1/1972 | Battistoni et al. | 195/56 |
| 3,723,250 | 3/1973 | Aunstrup et al. | 195/62 |
| 3,741,901 | 6/1973 | Ziffer | 252/89 |
| 4,067,773 | 1/1978 | Martin | 195/63 |
| 4,101,457 | 7/1978 | Place et al. | 252/559 |
| 4,142,999 | 3/1979 | Bloching et al. | 252/544 |
| 4,162,987 | 7/1979 | Maguire, Jr. et al. | 252/135 |
| 4,196,095 | 4/1980 | Cala et al. | 252/140 |
| 4,212,761 | 7/1980 | Ciaccio | 252/174.12 |
| 4,287,101 | 9/1981 | Nishio et al. | 252/537 |
| 4,381,247 | 4/1983 | Nakagawa et al. | 252/95 |
| 4,404,115 | 9/1983 | Tai | 252/135 |
| 4,480,037 | 10/1984 | Ichishima et al. | 435/221 |
| 4,511,490 | 4/1985 | Stanislowski et al. | 252/174.10 |
| 4,519,934 | 5/1985 | Eilertsen et al. | 252/174.12 |
| 4,568,476 | 2/1986 | Kielman et al. | 252/95 |
| 4,597,886 | 7/1986 | Goedhart et al. | 252/95 |
| 4,620,936 | 11/1986 | Kielman et al. | 252/99 |
| 4,692,260 | 9/1987 | Sung et al. | 252/99 |
| 4,900,475 | 2/1990 | Ramachandran et al. | 252/532 |
| 4,908,150 | 3/1990 | Hessel et al. | 252/174.12 |
| 4,923,631 | 8/1990 | Sims et al. | 252/186.42 |
| 4,927,558 | 5/1990 | Aaslyng et al. | 252/174 |
| 4,959,179 | 9/1990 | Aronson et al. | 252/135 |
| 5,071,586 | 12/1991 | Kaiserman et al. | 252/174.12 |
| 5,073,292 | 12/1991 | Hessel et al. | 252/174.12 |
| 5,082,585 | 7/1992 | Hessel et al. | 252/174.12 |
| 5,089,163 | 2/1992 | Aronson et al. | 252/135 |

FOREIGN PATENT DOCUMENTS

| | | |
|---|---|---|
| 58-213099 | 12/1983 | Japan . |
| 61-19679 | 5/1986 | Japan . |
| 2229894 | 9/1990 | Japan . |
| 2283800 | 11/1990 | Japan . |
| 04089899 | 7/1992 | Japan . |

OTHER PUBLICATIONS

NOVO Industri A/S Trade Literature for Detergent Enzymes dated Sep. 1981.

*Primary Examiner*—Paul Lieberman
*Assistant Examiner*—Kery Fries
*Attorney, Agent, or Firm*—Price, Heneveld, Cooper, DeWitt & Litton

[57] ABSTRACT

A high density, enzyme-containing powder detergent composition including a combination of alkaline proteases for improved cleaning characteristics and a combination of different density sodium carbonates for improved dispensing characteristics.

21 Claims, 3 Drawing Sheets

| | |
|---|---|
| EXPERIMENTAL DETERGENT (HIGH NONIONIC W/ EXP. ENZYME SYSTEM) | 80 GRM |
| COMMERCIAL DETERGENT A | 86 GRM |
| COMMERCIAL DETERGENT B | 81.5 GRM |
| COMMERCIAL DETERGENT C | 84.4 GRM |

| | 86 F / 14 GR | | | | 104 F / 14 GR | | | | 140 F / 14 GR | | | |
|---|---|---|---|---|---|---|---|---|---|---|---|---|
| SOIL | EXP. DET. | COMM A | COMM B | COMM | EXP. DET. | COMM A | COMM B | COMM C | EXP. DET. | COMM A | COMM B | COMM |
| TFI | 33.0 | 23.8 | 25.9 | 24.4 | 34.3 | 27.7 | 26.8 | 25.8 | 44.2 | 34.3 | 29.6 | 31.3 |
| EMPA | 28.9 | 21.0 | 22.7 | 20.6 | 31.7 | 21.5 | 24.7 | 21.7 | 46.9 | 32.2 | 30.5 | 25.9 |
| KREFELD | 18.6 | 17.2 | 18.4 | 10.5 | 18.1 | 14.5 | 13.1 | 13.2 | 32.8 | 21.9 | 18.8 | 18.7 |
| SPANGLER | 53.3 | 44.2 | 48.2 | 29.4 | 61.3 | 52.6 | 50.9 | 37.2 | 68.4 | 59.8 | 56.9 | 46.1 |
| OILY TOTAL | 100.0 | 79.4 | 86.1 | 63.5 | 100.0 | 80.0 | 79.4 | 67.3 | 100.0 | 77.1 | 70.6 | 63.4 |
| BBC | 92.0 | 90.4 | 93.4 | 88.3 | 102.0 | 92.6 | 91.5 | 92.4 | 106.4 | 98.1 | 98.1 | 93.2 |
| REDEP | 7.6 | 1.6 | 3.1 | 1.1 | 11.5 | 2.3 | 4.1 | 4.5 | 14.0 | 5.1 | 6.5 | 4.3 |
| GRASS | 84.5 | 75.0 | 77.4 | 32.8 | 95.1 | 93.4 | 102.2 | 54.7 | 128.3 | 114.1 | 116.6 | 45.2 |
| WINE | 6.7 | 5.6 | 7.6 | 1.6 | 26.8 | 28.9 | 33.4 | 23.2 | 38.6 | 31.8 | 39.2 | 16.3 |
| TEA | 13.5 | 6.9 | 13.2 | 2.9 | 8.5 | 3.5 | 8.6 | 0.0 | 18.6 | 3.6 | 9.8 | 0.3 |
| BMI | 14.4 | 10.8 | 11.6 | 6.1 | 20.4 | 21.5 | 14.0 | 14.3 | 26.2 | 20.0 | 19.5 | 8.2 |
| COCOA-LANOLIN | 61.9 | 49.5 | 57.2 | 44.7 | 76.0 | 48.0 | 55.7 | 76.3 | 86.7 | 68.4 | 66.5 | 55.4 |
| STAIN TOTAL | 100.0 | 87.3 | 96.0 | 64.6 | 100.0 | 86.1 | 94.3 | 73.9 | 100.0 | 79.7 | 84.3 | 42.0 |
| ALL SOILS | 100.0 | 84.7 | 92.7 | 64.3 | 100.0 | 83.7 | 87.5 | 74.6 | 100.0 | 80.0 | 80.5 | 56.4 |

Fig. 2

DETERGENT AND METHOD FOR PRODUCING THE SAME

BACKGROUND OF THE INVENTION

The present invention relates to a detergent composition and a method for producing the same, having improved cleaning characteristics and improved flow characteristics. Laundry detergents are expected to remove various kinds of soils from fabrics or clothes and to be easily dispensed from their containers. Regarding the removal of soils, among the soils expected to be removed by laundry detergents are oil-based soils including mineral oil, olive oil, wool fat and sebum. Other soils expected to be removed by laundry detergents are stains such as grass, wine, tea, blood, milk, ink and cocoa.

The detergency of detergent compositions largely is based upon their efficacy in removing the above-mentioned kinds of soils from fabric or clothes. It is well-known that while certain types of detergent compositions may exhibit strong detergency against one kind of soil, they may not exhibit good detergency against another.

One approach the art has taken to improve the effectiveness of detergent compositions is by the addition of enzymes such as proteases, amylases and lipases into detergent compositions. For example, alkaline proteases produced by cultivation of strains of Bacillus sp. in suitable nutrient media are widely used in detergent compositions. Examples of such commercial protease products are ALCALASE, ESPERASE and SAVINASE, all supplied by NOVO Industri A/S, Denmark. These and similar enzyme products such as MAXACAL from other commercial sources are active in detergent solutions, i.e., at pH values in the range of from 7 to 12 and in the presence of sequestering agents, surfactants and bleaching agents, such as sodium perborate. ALCALASE is produced by strains of the species *Bacillus licheniformis*. ESPERASE and SAVINASE are obtained by cultivation of strains of alkalophilic Bacilli according to U.S. Pat. No. 3,723,250, specifically from Bacillus Lentus and Bacillus Subtilis, respectively.

Since about 1928, various cleaning compositions, whether laundry detergents, dishwashing detergents, dry cleaning chemicals, etc., were patented which use two or more different enzymes, such as proteases and amylases, e.g., U.S. Pat. No. 1,660,458 and combinations of two different protease enzymes with an amylase, e.g., U.S. Pat. Nos. 2,607,359; 3,634,266 and 3,741,901. U.S. Pat. No. 4,511,490 discloses only combinations of two alkaline protease enzymes. In February 1982, Amway Corporation offered for sale and placed in public use a detergent incorporating the alkaline protease enzymes ALCALASE TM and ESPERASE TM available from NOVO, and an amylase enzyme.

U.S. Pat. No. 4,927,558 reports washing tests on mixtures of two alkaline proteases from Bacillus sp. in detergent. The data reported in the '558 patent supports the conclusion that mixtures of two alkaline proteases from Bacillus sp. was only slightly better than the detergency of a single protease.

Further, Japanese examined patent application publication 61-19,679 describes the use in a detergent of a combination of two proteases. The exemplified combination uses alkaline proteases from Bacillus sp., one of them being the alkali protease API-21, derived from Bacillus NKS-21 and also known as KAZUSASE. The data from washing tests do not show any improved detergency over the use of a single protease, but merely that the effect extends over a broader temperature range than that of each protease alone. The mixing ratio of the two proteases is 1:1 on activity basis. Thus, while a detergent additive comprising two alkaline proteases from Bacillus sp. for detergents is known, data showing improved detergency have not been published. Bacillus SP. alkali protease API-21 is the subject of U.S. Pat. No. 4,480,037.

In addition to being expected to remove various kinds of soils from fabrics or clothes, laundry detergents are also expected to be easily dispensed from automatic dispensers which some washing machines have. The current trend toward high density nonionic surfactant loaded powder laundry detergents has created a dispensing problem in such automatic dispensers for many powder detergents. There is a continuing need for a heavy duty, high density nonionic containing laundry detergent which also exhibits good dispensibility from automatic dispensing washing machines.

SUMMARY OF THE INVENTION

The present invention relates to a free-flowing, high density, enzyme-containing powder detergent composition comprising, in a first aspect of the invention, a combination of alkaline proteases for improved cleaning characteristics and, in a second aspect of the invention, a combination of different density sodium carbonates for improved flow characteristics. It has been surprisingly found that the broad range detergency of the combination of the three proteases is greater than that expected detergency of each individual protease. It has further been surprisingly found that the combination of the light density and medium light density sodium carbonates provides surprisingly improved dispensing characteristics while maintaining high bulk density. It is especially surprising in one embodiment that the highest bulk density occurs with a mixture containing a relatively high proportion of the lighter density sodium carbonate.

Further aspects and advantages of the invention will be apparent to those skilled in the art upon review of the following detailed description taken in conjunction with the appended claims.

BRIEF DESCRIPTION OF THE DRAWINGS

FIG. 2 illustrates in tabular form the results of the comparative study performed between the detergent composition according to the present invention and three leading competitive detergent compositions.

DETAILED DESCRIPTION OF THE INVENTION

Figure 1:
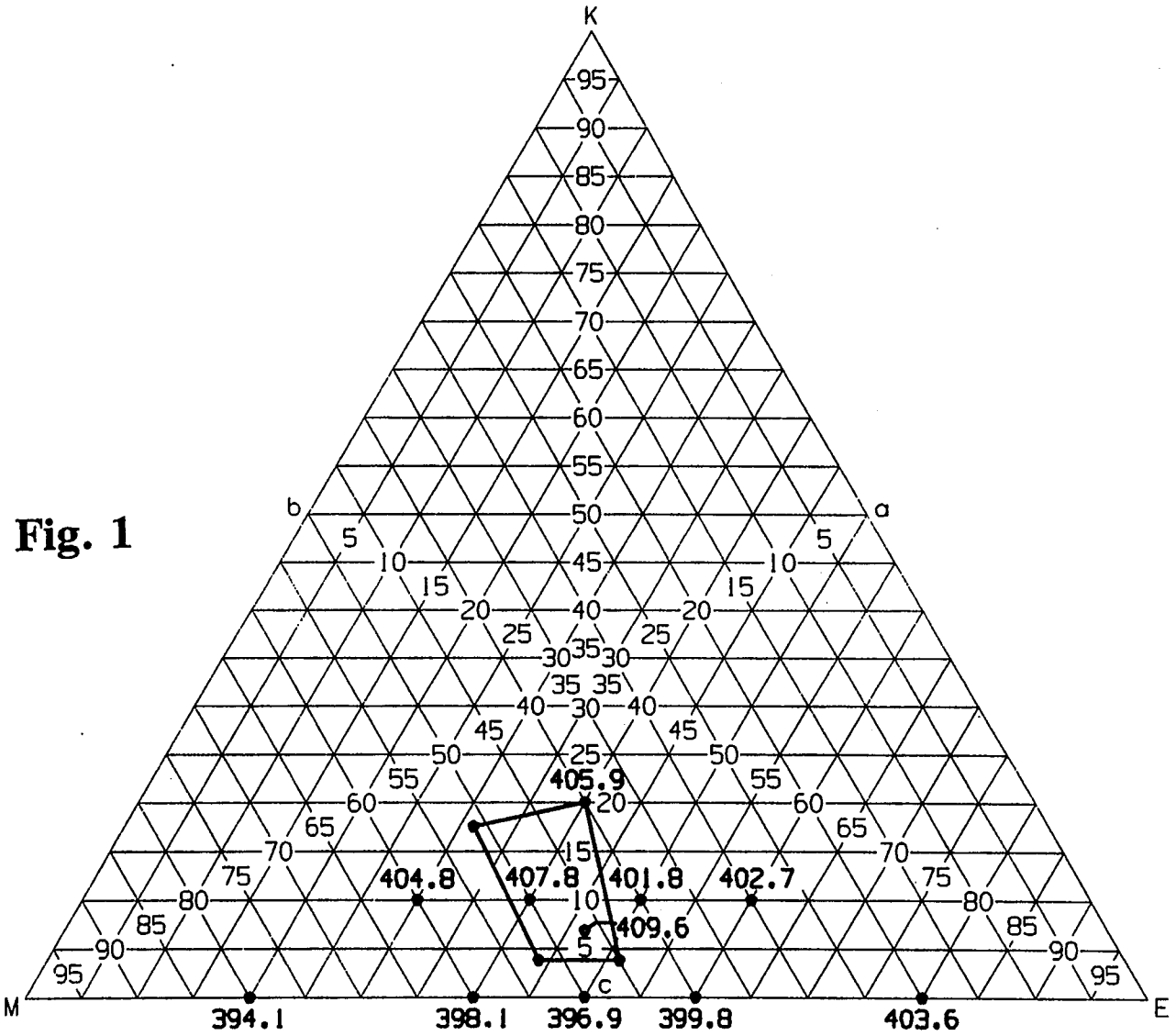
FIG. 1 graphically illustrates the optimum blend of the enzyme according to the present invention for all soils at all temperatures.

In the preferred embodiment, the detergent composition comprises from about 10% to about 25% nonionic surfactant, from about 0% to about 17% sodium carbonate having a density of from about 0.50 g/ml to about 0.56 g/ml, from about 15.5% to about 32.5% sodium carbonate having a density of from about 0.60 g/ml to about 0.65 g/ml, and from about 0.5% to about 1.5% of a combination of the Bacillus sp. proteases ESPERASE, MAXACAL and KAZUSASE. The enzymes are combined in the following ratios: from about 3.5 to about 20 parts by weight KAZUSASE; from about 31 to about 51 parts by weight ESPERASE; and from about 40 to about 52 parts by weight MAXACAL in 100 parts total enzyme. Unless stated to the contrary, the "percent" indications used herein stand for percentage by weight.

The nonionic surfactant is preferably liquid, i.e., has a melt point, at normal processing temperatures, i.e., at temperatures from about 20° to about 50° C. Suitable nonionic surfactant compounds fall into several different chemical types. These are generally polyoxyethylene or polyoxypropylene condensates of organic compounds having reactive hydrogen atoms. Illustrative, but not limiting, examples of suitable nonionic compounds are:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acid (derived from coconut oil) which contains an average of about 12 carbon atoms, "tallow" fatty acids (derived from tallow-class fats) which contain an average of about 18 carbon atoms, palmitic acid, myristic acid, stearic acid and lauric acid;

(b) polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol (derived from coconut oil), "tallow" fatty alcohol (derived from the tallow-class fats), lauryl alcohol, myristyl alcohol, and oleyl alcohol.

Particularly preferred nonionic surfactant compounds in this category are the "NEODOL" type products, a registered trademark of the Shell Chemical Company. NEODOL 23-6.5 and NEODOL 25-3 which are, respectively, $C_{12-13}$ and $C_{12-15}$ linear primary alcohol ethoxylates formed from 6.5 and 3 moles of ethylene oxide, respectively, have been found very useful in the present invention. NEODOL 45-13, a $C_{14-15}$ linear primary alcohol ethoxylate, has also been found effective in the present invention. Another preferred nonionic surfactant is a group of compounds sold under the registered trademark of "TERGITOL 15-S" manufactured by the Union Carbide Company. The "TERGITOL 15-S" materials are mixtures of $C_{11-15}$ secondary alcohol condensed with 9–14 molar proportions of ethylene oxide.

The nonionic surfactants can be present in the free-flowing detergent composition in the amount of about 25% by weight of the final product. Of course, the detergent benefits of high nonionic concentration must be balanced against cost-performance. Therefore, the more preferred range for the nonionic surfactants is about 15% to about 20% by weight of the final product.

The enzyme component of the present detergent composition is an effective amount of an enzyme mixture which comprises the alkaline protease enzymes ESPERASE, MAXACAL, and KAZUSASE. A preferred substitute for MAXACAL is the alkaline protease SAVINASE. ESPERASE and SAVINASE are available from NOVO Industri A/S, Bagsvaerd, Denmark while MAXACAL is available from Gist Brocades, N.V., Delft, Netherlands. KAZUSASE is available from Showa Denko K.K., Tokyo, Japan. This blend of alkaline proteases has an optimal activity at pH ranging from neutral to 11 and at temperatures ranging from 30° C. to 60° C.

The sodium carbonate component used in the present detergent composition is a mixture of light density synthetic sodium carbonate having a density of from about 0.50 g/ml to about 0.56 g/ml and a special high porosity "medium-light" sodium carbonate (Grade 90) having a density of from about 0.60 g/ml to about 0.65 g/ml. Such a light density sodium carbonate is available from General Chemical Co. Ltd. (Canada). The medium light sodium carbonate is commercially available from FMC Corporation.

The ratio of light density sodium carbonate to medium light density sodium carbonate should be from about 65/35 to about 30/70. From about 10% to about 17% of the light density sodium carbonate and from about 15.5% to about 22.5% of the medium-light sodium carbonate are present in the mixture in the most preferred embodiment. The amount of sodium carbonate added to the final product is balanced against the amount of nonionic surfactant which will be loaded into the sodium carbonate. The more preferred range for the total amount of sodium carbonate present in the final product is from about 30% to about 45%.

Other typical detergent ingredients may also be used in the preferred embodiment. Peroxy-bleach agents along with their activators, suds-controlling agents and suds-boosters may be included. Minor ingredients such as anti-tarnishing agents, dyes, buffers, perfumes, anti-redeposition agents, colorants, and fluorescers may be included.

The preferred blend of the three enzymes used in the present invention was identified by performing a series of experiments to determine the percentage of each enzyme needed in a detergent formulation to provide optimal detergent performance over a range of temperatures and with a variety of stain combinations. The total amount of enzyme used in the detergent formulation was 1%. The soils studied for the comparison of enzyme effectiveness were as follows: a water homogenized grass slurry (GR), a blood-milk-ink stain (BMI), and a cocoa-milk-sugar stain (CMS).

The experimental protocol initially called for obtaining performance data for each enzyme alone, in a 50/50 blend with another of the enzymes, and with the three enzymes each constituting a third of the total enzyme content of the detergent composition. This data was obtained for each soil at two temperatures: 100° F. and 140° F. The data was then qualitatively analyzed to determine how the enzyme blend should be adjusted to enhance performance. After this judgment was made, a second series of experiments was conducted for each soil and at the same two temperatures. This data was again qualitatively analyzed to make a judgment as to the preferred blend of the three enzymes. A third series of experiments on the same soils at three temperatures, 70°, 100° and 140° F., led to the selection of the preferred range of the enzyme blend illustrated in FIG. 1.

With reference to FIG. 1, the apexes are labeled K for KAZUSASE, M for MAXACAL (a SAVINASE equivalent) and E for ESPERASE. The apexes of the graph represent a 1% level of each of the enzymes, singly. The points inside the triangle represent various mixtures of enzymes. The furthest side opposite each apex represents 0% of that enzyme. The point in the center of the triangle (equidistant from all three apexes) represents an equal mixture (0.333% each) of the three enzymes. The total amount of enzyme in each detergent formulation is 1%. The values indicated on the graph represent the sum of reflectance differences observed for all soil/temperature conditions tested.

As shown in FIG. 1, the enzymes ESPERASE, MAXACAL and KAZUSASE are present relative to each other in the detergent in the following amounts: from about 3.5% to about 20% KAZUSASE; from about 31% to about 51% ESPERASE; and from about 40% to about 52% MAXACAL. A preferred range for KAZUSASE is from about 9% to about 14.5% and a most preferred amount of KAZUSASE in the detergent is about 10%. A preferred range for ESPERASE is from about 38% to about 44% ESPERASE and a most preferred amount of ESPERASE in the detergent is about 45%. A preferred range for MAXACAL is from about 44% to about 50% MAXACAL and a preferred amount of MAXACAL in the detergent is about 45%.

In the experiments to determine the optimum blend of enzymes, the data was obtained using artificial soil cloths washed in a European front loading washing machine (Siemans SIWAMAT 484). Four by four swatches were attached to towels via plastic staples and washed using the standard was cycles. The washing tests were performed in water having a hardness of 14 GR and at temperatures of 70°, 100° and 140° F. The total wash load included the soil cloths and towel carriers, as well as additional fill (mixed fabric load) to a total of 4.5 kilograms dry weight of fabric. After washing, the soil swatches were removed and press-dried between clean paper toweling using a photographic print dryer. The swatches were then read to determine the reflectance values after washing, and the increase in reflectance was calculated as a measure of cleaning. Swatches were read for reflectance using a Hunterlab Colorimeter "Colorquest" system. Swatches were read for Rd (black/white), A (red/green) and B (yellow/blue). The machine and filler cloths were also cleaned and rinsed between each detergent to eliminate "carry-over" effects.

Having performed the experiments to determine the enzyme blend having performance optimums for each soil/temperature combination tested, the detergency of the enzyme blend was compared to three leading commercial European detergents. As above, data was obtained using artificial soil cloths washed in a European front loading washing machine (Siemans SIWAMAT 484). Four by four swatches were attached to towels via plastic staples and washed using the standard wash cycles and recommended dosages of the comparative commercial detergents.

The washing tests were performed in water having a hardness of 14 GR and at temperatures of 30°, 40° and 60° C. As above, the total wash load included the soil cloths and towel carriers, as well as additional fill (mixed fabric load), to a total of 4.5 kilograms dry weight of fabric. After washing, the soil swatches were removed and press-dried between clean paper toweling using a photographic print dryer. The swatches were then read to determine the reflectance values after washing, and the increase in reflectance was calculated as a measure of cleaning. The machine and filler cloths were cleaned and rinsed between each detergent to eliminate "carry-over" effects.

Again, as with the enzyme blend experiments, the swatches were read for reflectance using a Hunterlab Colorimeter "Colorquest" system. Swatches were read for Rd (black/white), A (red/green), B (yellow/blue) and Whiteness Index, before and after washing. Results were given as the change in Rd or Whiteness Index. (Whiteness Index was used for some colored stains and redeposition soils—grass stains, spangler sebum soil, clay soil, tea, coffee.) Results were also totalled according to soil type and normalized versus one product used as a control at 100% performance (e.g., oily soil total, stain total, etc.).

The data from these comparative tests is shown in FIG. 2. The soils referred to ill FIG. 2 are as follows:

TFI—Testfabrics Inc. oily soil - mineral oil base
EMPA—EMPA standard soil - olive oil base
Krefeld—WFK standard soil - wool fat/soot
Spangler—synthetic human sebum soil with dust particles
Clay—dry soiled, ground-in Bandy black research clay
Grass—grass stains using a water homogenized grass slurry
BMI—blood-milk-ink stain
Cocoa/Lanolin—CFT cocoa-lanolin soilcloth
Wine—EMPA red wine stain cloth
Tea—tea stain cloth prepared by soaking in a strong black tea solution
Coffee—CFT coffee stain cloth EMPA, WFK and CFT are, respectively, Swiss based, German based and Dutch based detergent testing/supply organizations.

Review of the data from FIG. 2 indicates that the detergent composition of the preferred embodiment, when compared to the performance of the other leading detergents, provided improved cleaning characteristics across the entire broad spectrum of oils and stains and over the wide temperature range. While commercial detergent B outperformed the claimed detergent composition in six individual comparison trials, the overall performance of detergent B was inferior to that of the claimed detergent composition.

Specifically, commercial detergents A, B and C never defeated the claimed detergent in effectiveness against the totalled oily soils or stain soils at any of the studied temperatures. For oily soils, the claimed detergent exhibits superior results. In 8 out of 9 dual comparisons, the claimed detergent had cleaning characteristics for oils which were at least 20% better than the comparison detergents and at least 13% better in all comparisons. For 20 stain soils, the claimed detergent was at least 20% better than the comparison detergents in 4 out of 9 trials and at least 12% better in 7 out of 9 comparisons. Therefore, the data indicate that the claimed enzyme combination has surprisingly superior cleaning characteristics over a broad range of soils and temperatures.

In addition to these surprising findings regarding the cleaning characteristics of the claimed enzyme blend, it has further been surprisingly found that the combination of two different light and medium light density sodium carbonates in a ratio of 65/35 to 30/70 light-/medium light density provides surprisingly higher bulk densities while dispensability from automatic dispensing washing machines is maintained. Product continues to dispense at a very low water flow rate, i.e., 0.5 gal/min.

Figure 3:
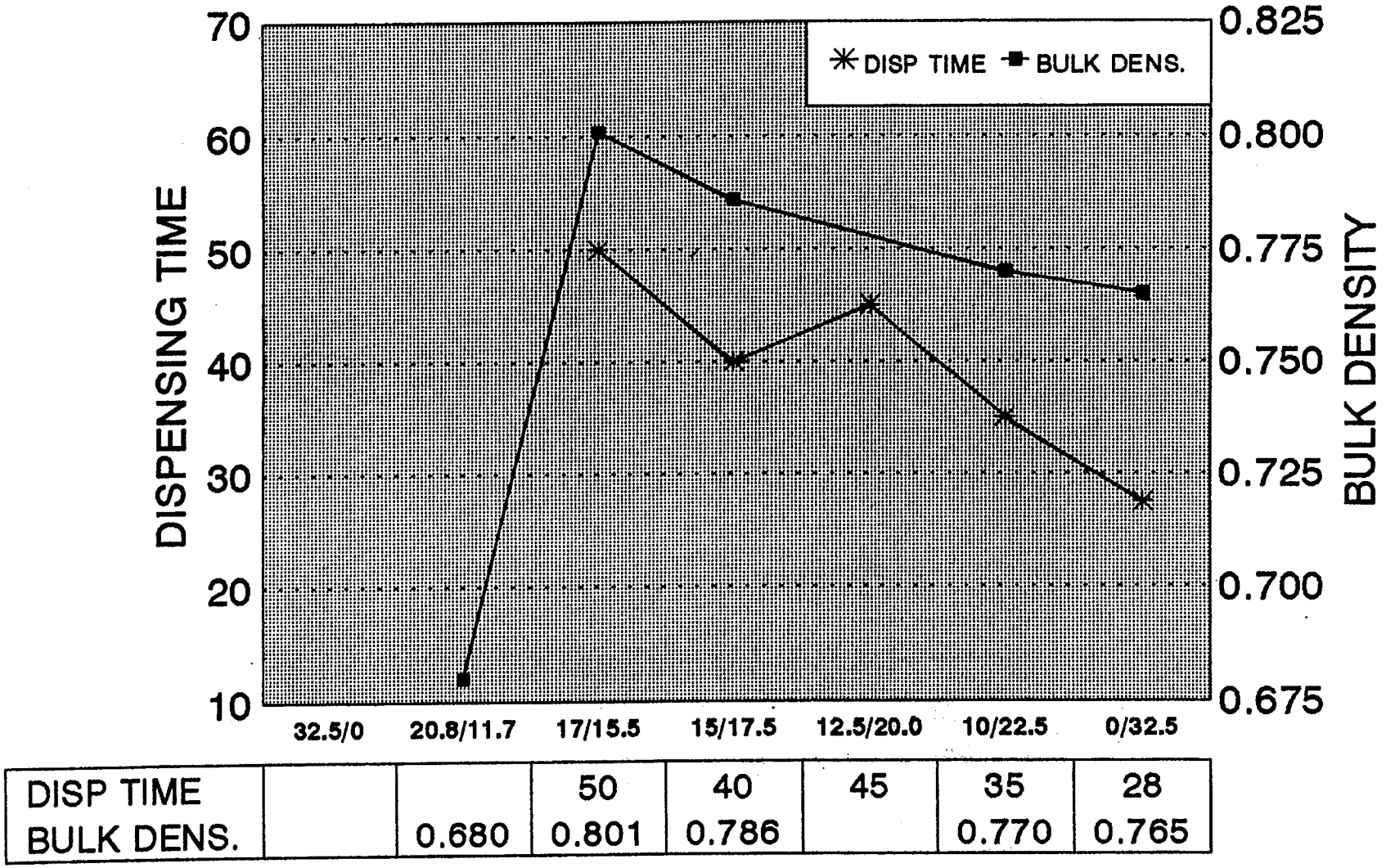
FIG. 3 graphically illustrates the dispensing time, bulk density and the optimum blend of the different density sodium carbonates according to the present invention.

FIG. 3 graphically illustrates the dispensing time, bulk density and the optimum blend of the different density sodium carbonates. Producing a detergent composition with a high bulk density is preferred because the consumer needs to use less volume of the product to obtain the same cleaning power as compared to a detergent composition with a lower bulk density. Further, because the consumer needs less detergent per load, the manufacturer can reduce the size of the packaging for the detergent composition while maintaining the same number of washes per box, thus reducing the amount of paper entering the waste stream. Dispensing time is a measure of the ease with which product is dispensed from the automatic dispenser of the washing machine. The ability of the product to dispense completely and quickly, even at low water flow rates, as often the case in Europe, is important. Product that is not dispensed, i.e., carried with the water into the inside of the washing machine, is wasted and is an inconvenience to the consumer.

An analysis of the data presented in FIG. 3 indicates that a detergent composition having from about 10% to about 17% light ash and from about 15.5% to about 32.5% grade 90 ash produces detergent compositions having relatively high bulk densities. The detergent composition having 20.8% light ash and 11.7% grade 90 ash has a dramatically lower bulk density of 0.68. The data also reveal that as the amount of grade 90 ash increases, the dispensing time decreases. Dispensing time was calculated by measuring the amount of time it took to disperse an 80 gram sample from a washing machine having a side flow dispenser with a water flow rate of 1.9 liter/minute. Lower dispensing times are viewed as "better." The data indicate, therefore, that surprisingly high bulk density detergent compositions can be obtained by the combination of a light density sodium carbonate having a density from about 0.50 g/ml to about 0.56 g/ml with a different light density sodium carbonate having a density from about 0.60 g/ml to about 0.65 g/ml. This combination of sodium carbonates also provides surprisingly improved dispensing characteristics.

The preparation of the enzyme blend/carbonate blend containing detergent composition can be carried out in any conventional manner known in the art.

The foregoing detailed description is given for clearness of understanding only, and no unnecessary limitations should be understood therefrom, as aspects and advantages within the scope of the present invention will be apparent to those skilled in the art.

The embodiments of the invention in which an exclusive property of privilege is claimed are defined as follows:

1. An enzyme-containing powder detergent composition comprising:

from about 10% to about 25% surfactant;

from about 30% to about 45% alkaline builder; and from about 0.5% to about 1.5% of a combination of the Bacillus sp. alkaline proteases, including a first enzyme derived from Bacillus Lentus, a second enzyme derived from Bacillus Subtilis, and a third enzyme derived from Bacillus NKS-21 and known in the art as alkali protease AP-21, the enzymes being present relative to one another in the detergent in the following amounts: from about 3.5 to about 20 parts by weight said third enzyme; from about 31 to about 51 parts by weight said first enzyme; and from about 40 to about 52 parts by weight said second enzyme in 100 parts by weight enzyme.

2. The composition of claim 1, wherein from about 9 to about 14.5 parts of said third enzyme are present.

3. The composition of claim 1, wherein from about 38 to about 44 parts of said first enzyme are present.

4. The composition of claim 1, wherein from about 44 to about 50 parts of said second enzyme are present.

5. The composition of claim 1, wherein said enzymes are present in the detergent in the following amounts: 10 parts of said third enzyme, 45 parts of said first enzyme, and 45 parts of said second enzyme per 100 parts enzyme.

6. The composition of claim 5, in which the surfactant is a nonionic surfactant.

7. The composition of claim 6, in which the alkaline builder is sodium carbonate.

8. The composition of claim 5, in which the alkaline builder is sodium carbonate.

9. The composition of claim 1, in which the surfactant is a nonionic surfactant.

10. The composition of claim 9, in which the alkaline builder is sodium carbonate.

11. The composition of claim 1, in which the alkaline builder is sodium carbonate.

12. A high density, readily dispensable detergent comprising:

from about 15 to about 20% nonionic surfactant; and from about 30% to about 45% of a blend of light density sodium carbonate having a density of from about 0.5 g/ml to about 0.56 g/ml and a medium light density sodium carbonate having a density of from about 0.60 g/ml to about 0.65 g/ml, said light to medium light density carbonates being present in a ratio of from about 65:35 to about 30:70 with respect to one another.

13. The detergent composition of claim 12, which also includes from about 0.5% to about 1.5% of at least one enzyme.

14. The detergent composition of claim 13, in which said at least one enzyme comprises an alkaline protease enzyme.

15. The detergent composition of claim 14, in which said enzyme comprises a blend of said first, second, and third enzymes.

16. The detergent composition of claim 15, in which said three enzymes are present relative to one another in the following amounts: from about 3.5 to about 20 parts by weight of said third enzyme, from about 31 to about 51 parts by weight of said first enzyme, and from about 40 to about 52 parts by weight of said second enzyme in 100 parts by weight enzyme.

17. A high density, readily dispensable powder detergent composition comprising:

from about 15% to about 20% nonionic surfactant;

from about 10% to about 17% sodium carbonate having a density of from about 0.50 g/ml to about 0.56 g/ml; and from about 15.5% to about 32.5% sodium carbonate having a density of from about 0.60 g/ml to about 0.65 g/ml.

18. The detergent composition of claim 17, which also includes from about 0.5% to about 1.5% of at least one enzyme.

19. The detergent composition of claim 18, wherein said enzyme is at least one proteolytic enzyme derived from bacteria.

20. The detergent composition of claim 19, wherein said enzyme is at least one Bacillus sp. alkaline protease.

21. A method for optimizing the bulk density and dispensibility of a nonionic detergent composition from an automatic dispensing washing machine comprising:

using from about 30% to about 45% by weight of a blend of a light density sodium carbonate having a density of from about 0.50 g/ml to about 0.56 g/ml and a medium light density sodium carbonate having a density of from about 0.60 g/ml to about 0.65 g/ml in a ratio of said light to medium light density carbonates of from about 65:35 to about 30:70 in said composition to be dispensed in said machine, along with from about 15% to about 20% by weight of a nonionic surfactant.

* * * * *

UNITED STATES PATENT AND TRADEMARK OFFICE

CERTIFICATE OF CORRECTION

PATENT NO. : 5,429,765

DATED : July 4, 1995

INVENTOR(S) : David M. Flower

It is certified that error appears in the above-indentified patent and that said Letters Patent is hereby corrected as shown below:

Column 5, Line 31:

"was" should be --wash--.

Column 6, Line 17:

"ill" should be --in--.

Column 6, Line 53:

Before "stain" delete --20--.

Column 7, Line 16:

After "as" insert --is--.

Signed and Sealed this

Ninth Day of April, 1996

Bruce Lehman

*Attest:*

BRUCE LEHMAN

*Attesting Officer*

*Commissioner of Patents and Trademarks*